US006700328B2

(12) United States Patent
Toyama

(10) Patent No.: US 6,700,328 B2
(45) Date of Patent: Mar. 2, 2004

(54) DISCHARGE LAMP DRIVER CIRCUIT DESIGNED TO MINIMIZE RADIATION OR NOISE

(75) Inventor: Koichi Toyama, Kariya (JP)

(73) Assignee: Denso Corporation, Kariya (JP)

( * ) Notice: Subject to any disclaimer, the term of this patent is extended or adjusted under 35 U.S.C. 154(b) by 40 days.

(21) Appl. No.: 10/234,130

(22) Filed: Sep. 5, 2002

(65) Prior Publication Data

US 2003/0057870 A1 Mar. 27, 2003

(30) Foreign Application Priority Data

Sep. 7, 2001 (JP) ..... 2001-272675

(51) Int. Cl.[7] ..... H01J 1/52

(52) U.S. Cl. ..... 315/85; 315/209 R; 315/224; 315/246; 315/291; 313/313

(58) Field of Search ..... 315/85, 209 R, 315/246, 291, 363, 224; 313/313, 402, 440

(56) References Cited

U.S. PATENT DOCUMENTS 4,998,006 A * 3/1991 Perlman ..... 219/212
5,675,220 A * 10/1997 Dault et al. ..... 315/77
6,201,350 B1 3/2001 Okuchi et al. ..... 315/82

FOREIGN PATENT DOCUMENTS

JP 2000-156294 6/2000
JP 2001-43984 2/2001

* cited by examiner

*Primary Examiner*—Tuyet T. Vo
(74) *Attorney, Agent, or Firm*—Posz & Bethards, PLC

(57) ABSTRACT

A discharge lamp driver circuit is provided which features a field canceller. The driver circuit includes a power supply circuit which turns on and off a switching element to step up a dc voltage and provide it for turning on a discharge lamp. The power supply circuit includes an electrical path through which an interrupted current arising from the on-off operation of the switching element flows. The field canceller includes an electric line through which the interrupted current having passed through the electrical path flows in an opposite direction, thereby producing a field canceling a field caused by flow of the interrupted current through the electrical path.

7 Claims, 8 Drawing Sheets

DISCHARGE LAMP DRIVER CIRCUIT DESIGNED TO MINIMIZE RADIATION OR NOISE

BACKGROUND OF THE INVENTION

1. Technical Field of the Invention

The present invention relates generally to a discharge lamp driver circuit working to turn on a discharge lamp, and more particularly to a noise canceller structure of such a discharge lamp driver circuit which is designed to minimize radiation of noises arising from a switching operation of the driver circuit.

2. Background Art

FIG. 7 shows a typical discharge lamp driver circuit 100 for automotive vehicles which includes a filter circuit 110, a DC/DC converter 120, an inverter 130, and a control circuit 150. The discharge lamp driver circuit 100 works to step up a dc voltage supplied from a storage battery 10 through the DC/DC converter 120 when a lighting switch 20 is turned on and converts it into an ac voltage through the inverter 130 to initiate a discharge in a lamp 30.

The lamp 30 is a discharge lamp such as a metal halide lamp typically used as a headlamp of the vehicle. Starting the lamp 30 is achieved by inducing a dielectric breakdown through a transformer (not shown) of a starter circuit to develop a high voltage between electrodes of the lamp 30. After the dielectric breakdown, the status of the lamp 30 is shifted from a glow discharge to an arc discharge to keep the lamp 30 lightened stably.

The filter circuit 110 consists of a coil 111, a capacitor 112, and a capacitor 113 and works as a noise filter.

The DC/DC converter 120 consists of a transformer 121 made up of a primary winding 121*a* connected to the battery 10 and a secondary winding 121*b* connected to the lamp 30, a MOS transistor (field-effect transistor) 122 connected to the primary winding 121*a*, rectifier diode 123, and a smoothing capacitor 124 and works to step up and output the voltage from the battery 10. Specifically, when the MOS transistor 122 is turned on, it will cause a primary current to flow through the primary winding 121*a* so that energy is accumulated in the primary winding 121*a*. When the MOS transistor 122 is turned off, it will cause the energy in the primary winding 121*a* to be supplied to the secondary winding 121*b*. Such turning on and off the MOS transistor 122 is repeated, thereby causing a high voltage to be outputted from a junction of the diode 123 and the smoothing capacitor 124. The transformer 121 may alternatively be so constructed that the primary and secondary windings 121*a* and 121*b* are electrically connected to each other.

The inverter 130 includes MOS transistors (not shown) arrayed in the form of an H-bridge which work to provide the ac current for turning on the lamp 30.

The control circuit 150 is responsive to a signal (lamp power signal) provided by a power detector (not shown) as functions of a lamp current and a lamp voltage to control the MOS transistor 122 in a PWM mode so as to bring the lamp power into agreement with a maximum (e.g., 65 W) when turning on the lamp 30 and with a constant power (e.g., 35 W) subsequently.

The control circuit 150 consists of a gate control circuit 150*a* controlling the on-off operation of the MOS transistor 122 in the PWM mode, the power detector detecting the lamp voltage, and a lamp power control circuit (not shown) controlling the lamp power to bring it into agreement with a target one based on the detected lamp current and voltage.

In operation, when the lighting switch 20 has been turned on, and the control circuit 150 has started to control the MOS transistor 122 in the PWM mode, the DC/DC converter 120 outputs the voltage produced by stepping up the voltage of the battery 10 through the transformer 121. The high-voltage produced by the DC/DC converter 120 (300V to 500V in the course of preparation for turning on the lamp 30, and about 100V after turning on the lamp 30) is further stepped up to, for example, 25 kV through the inverter 130 so that the dielectric breakdown may occur in the transformer of the starter circuit and applied to the lamp 30. This causes the lamp 30 to be turned on. After turning on the lamp 30, the polarity of the voltage to be outputted by the inverter 130 is reversed cyclically to provide the ac voltage to the lamp 30.

The above structure of the discharge lamp driver circuit 100 has a drawback in that interrupted currents arising from the on and off operations of the MOS transistor 122 of the DC/DC converter 120 to step up the voltage of the battery 10 result in radiation of noises.

The interrupted currents flow through three electrical loops: a first electrical path Lp1 extending from the capacitor 113 through a power source positive line to the primary winding 121*a* of the transformer 121 to a drain and a source of the MOS transistor 122 and back to the capacitor 113 through a ground line, a second electrical path Lp2 extending from the rectifier diode 123 to the smoothing capacitor 124 to the ground line to the secondary winding 121*b* and back to the rectifier diode 123, and a third electrical path Lp3 extending from the gate control circuit 150*a* to the gate of the MOS transistor 122 to the ground line and back to the gate control circuit 150*a*. The first, second, and third electrical paths Lp1, Lp2, and Lp3 carry currents i1, i2, and i2 arising from the on and off operations of the MOS transistor 122 by the gate control circuit 150*a*.

Particularly, in a case where the above structure of the discharge lamp driver circuit 100 is installed in an automotive vehicle for lighting headlamps, when a traffic light has changed to red, and the vehicle has stopped close to an antenna installed in the rear of a preceding vehicle, it may cause electric noises to be radiated forwardly, which raise a radio disturbance in the preceding vehicle.

SUMMARY OF THE INVENTION

It is therefore a principal object of the invention to avoid the disadvantages of the prior art.

It is another object of the invention to provide a discharge lamp driver circuit designed to minimize adverse effects caused by interrupted currents produced in the driver circuit.

According to one aspect of the invention, there is provided a discharge lamp driver circuit which may be employed in turning on a discharge lamp as used as a headlamp of automotive vehicles. The discharge lamp driver circuit comprises: (a) a power supply circuit connected to a de power supply; and (b) a field canceller. The power supply circuit includes a switching element and performs an on-off operation on the switching element to step up a dc voltage from the dc power supply and provide the stepped up dc voltage for turning on a discharge lamp. The power supply circuit includes an electrical path through which an interrupted current arising from the on-off operation of the switching element flows. The field canceller includes an electrical line through which the same interrupted current as that flowing through the electrical path of the power supply circuit flows, thereby producing a field canceling a field caused by flow of the interrupted current through the electrical path. This causes electrical noises radiated outside from the electrical path of the power supply circuit to be eliminated.

In the preferred mode of the invention, the power supply circuit includes a DC/DC converter. The DC/DC converter consists of a transformer made up of a primary winding connected to the dc power supply and a secondary winding connected to the discharge lamp and the switching element and works to turning on and off the switching element to provide the stepped up dc voltage to the discharge lamp through the transformer.

The electrical line of the field canceller is connected in series with the electrical path of the power supply circuit and extends so as to have the interrupted current bypass the electrical path in an orientation opposite flow of the interrupted current through the electrical path. This causes the field to be produced by the field canceller which is identical in strength and 180° out of phase with the field arising from the interrupted current flowing through the electrical path.

The electrical line of the field canceller may be so geometrically shaped as to have an area surrounded by the electrical line which is substantially identical with an area surrounded by the electrical path of the power supply circuit. The field provided by the field canceller will, thus, be identical in strength with that produced around the electric path, thereby resulting in complete cancellation of noises arising from the field produced around the electrical path.

The electrical line of the field canceller may be laid over the electrical path of the power supply circuit so that a magnetic flux produced by the electric line of the field canceller overlaps a magnetic flux produced by the electrical path of the power supply circuit, thereby promoting cancellation of noises arising from the field produced around the electric path.

The field canceller includes an insert molded body within which the electrical line is disposed.

The field canceller may be implemented by a flexible substrate.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
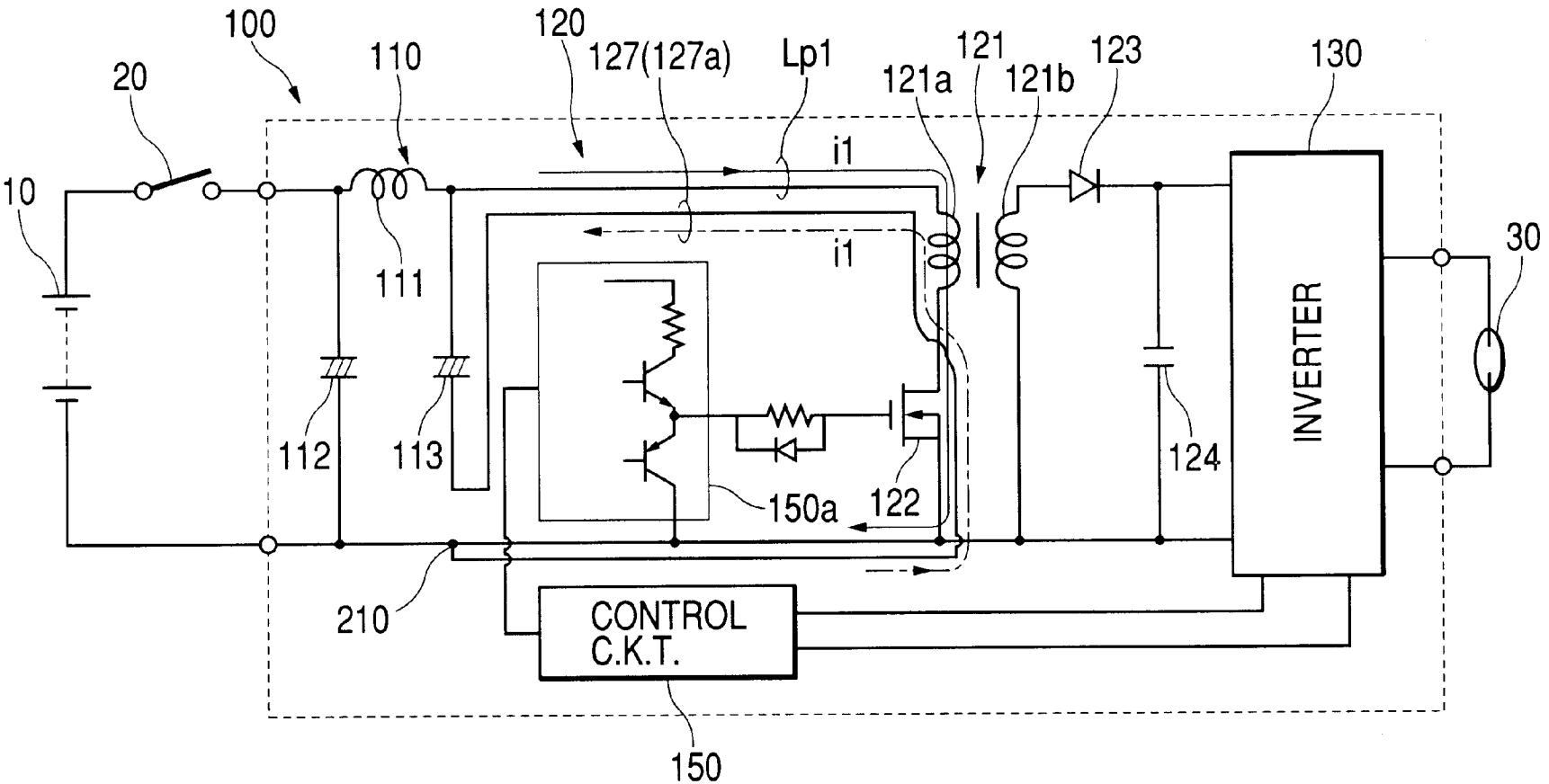
FIG. 1 is a circuit diagram which shows a discharge lamp driver circuit according to the first embodiment of the invention.

Referring to the drawings, wherein like reference numbers refer to like parts in several views, particularly to FIG. 1, there is shown a discharge lamp driver circuit 100 according to the first embodiment of the invention which may be employed in turning on headlamps of an automotive vehicle. The same reference numbers as employed in FIG. 7 will refer to the same parts, and explanation thereof in detail will be omitted here.

Figure 2:
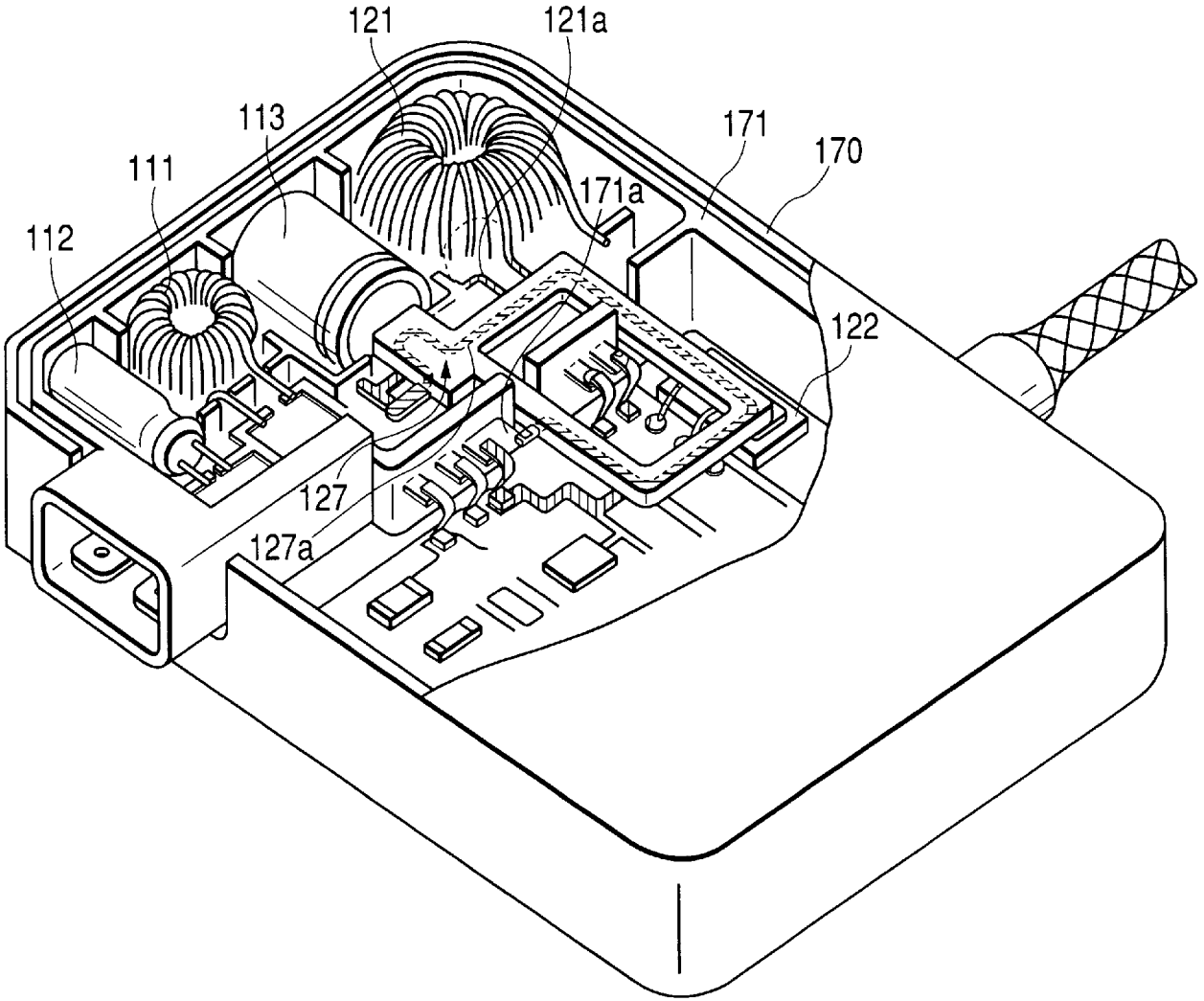
FIG. 2 is a partially cutaway view which shows the discharge lamp driver circuit of FIG. 1 installed in a casing.
Figure 7:
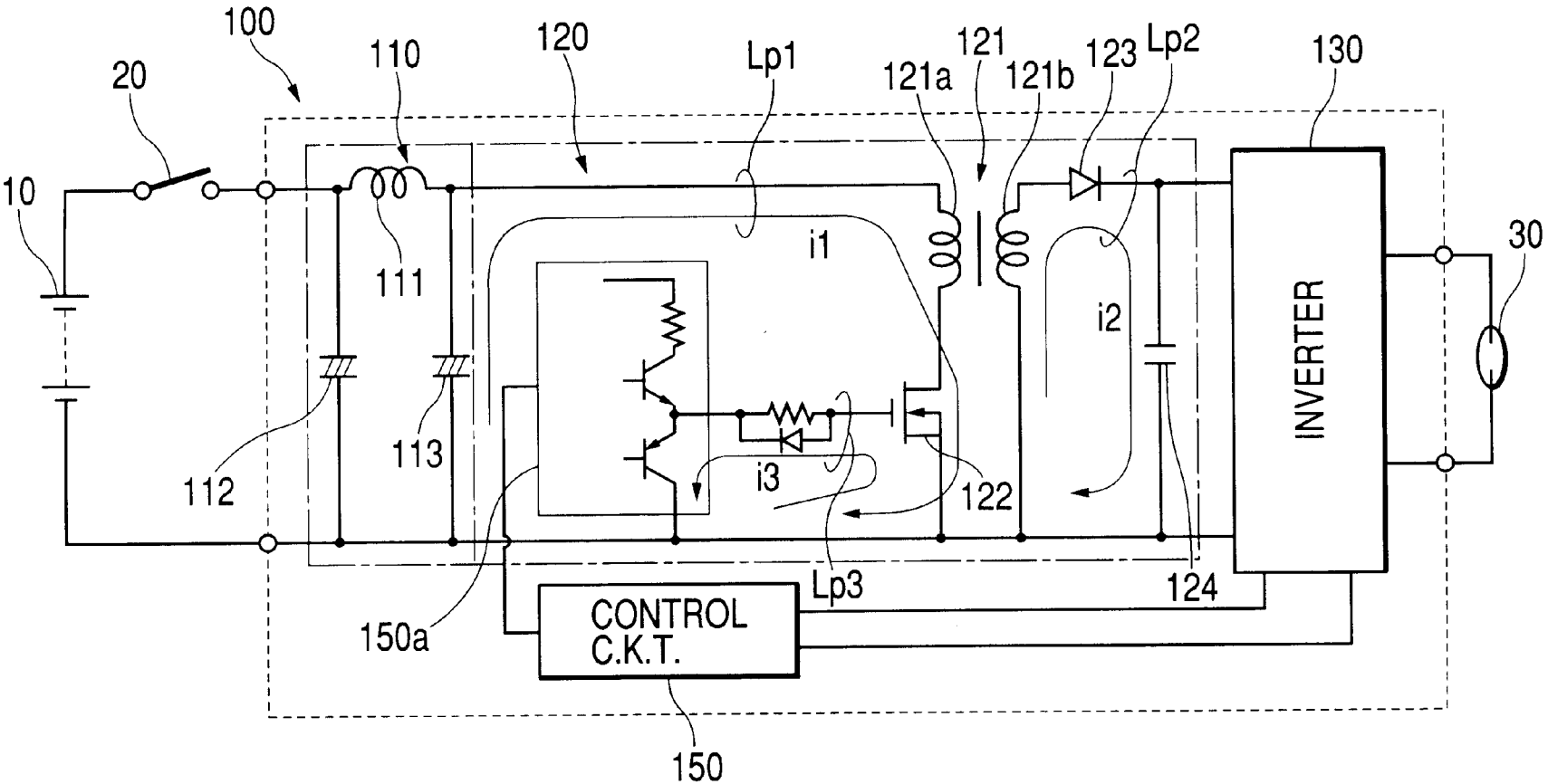
FIG. 7 PRIOR ART
FIG. 7 is a circuit diagram which shows a typical discharge lamp driver circuit.

The discharge lamp driver circuit 100 of this embodiment is different from the one shown in FIG. 7 in structure of the DC/DC converter 120. Specifically, the DC/DC converter 120 includes, as shown in FIG. 2, a field canceller 127 which works to cancel a magnetic field produced by the interrupted current i1 which arises, as already described in the introductory part of this application, from on and off operations of the MOS transistor 122 and flows through the first electrical path Lp1.

The field canceller 127 is, as clearly shown in FIG. 1, made of a circuit line 127*a* which is connected in series with the first electrical path Lp1 and has the interrupted current i1 bypass the first electrical path Lp1. In the conventional structure as illustrated in FIG. 7, the first electrical path Lp1, as discussed above, extends from the capacitor 113 to the primary winding 121*a* of the transformer 121 to the drain and source of the MOS transistor 122 and back to the capacitor 113, however, the first electrical path Lp1 of this embodiment extends from the capacitor 113 to the primary winding 121*a* of the transformer 121 to the drain and source of the MOS transistor 122 and to a junction 210. The circuit line 127*a* extends from the junction 210 to the capacitor 113 along the first electrical path Lp1 and is so laid that a magnetic flux produced by the circuit line 127*a* may overlap with that produced by the first electrical path Lp1 vertically.

The circuit line 127*a* works to carry a current which is identical in scale with the interrupted current i1 and oriented, as indicated by a dashed line in FIG. 1, in a direction opposite the flow of the interrupted current i1 to produce a field which is identical in strength and 180° out of phase with the field arising from the interrupted current i1, thereby canceling noises radiated by the on and off operations of the MOS transistor 122 controlled by the gate control circuit 150*a*.

The circuit line 127*a* of the field canceller 127 may be provided flush with the first electrical path Lp1 or on a plane which is in the proximity of the first electrical path Lp1 and different in level from a plane containing the flow of the interrupted current i1 through the first electrical path Lp1.

Figure 8:
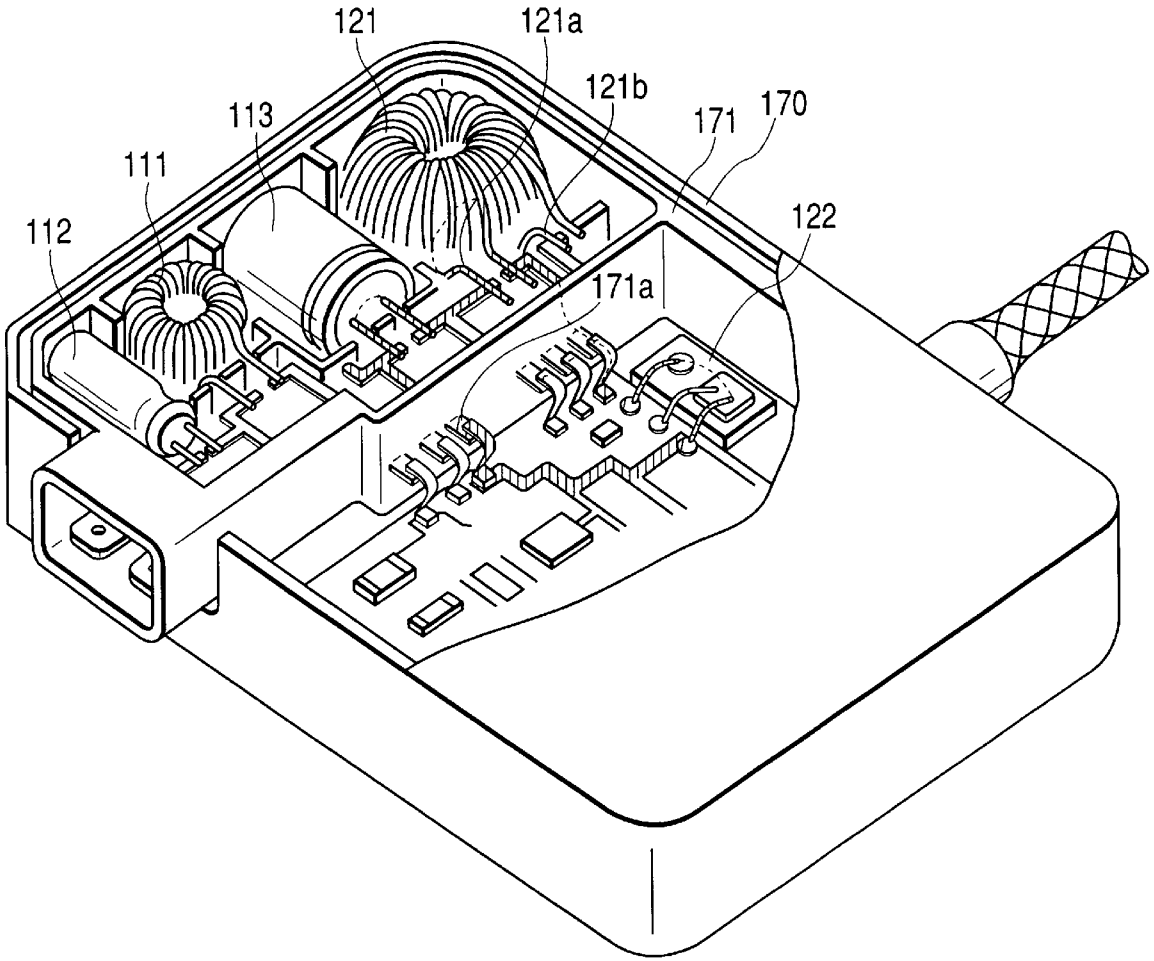
FIG. 8 PRIOR ART
FIG. 8 is a partially cutaway view which shows the discharge lamp driver circuit of FIG. 7 installed in a casing.

FIG. 2 is a partially cutaway view which shows an internal structure of the DC/DC converter 120. Similarly, FIG. 8 is a partially cutaway view which shows the DC/DC converter 120 in the typical discharge lamp driver circuit 100 of FIG. 7. In FIG. 8, a hatched portion is the first electrical path Lp1.

The circuit line 127*a* of the field canceller 127 is, as shown in FIG. 2, implemented by a terminal made of, for example, copper wire which is installed in a resinous insulator in the insert molding and joined in series with the first electrical path Lp1. The circuit line 127*a* extends over the first electrical path Lp1 on a plane defined at a level different from the first electrical path Lp1. The use of the resinous insulator results in fixing of a geometric pattern of the circuit line 127*a*, thus keeping the strength of the field produced by the interrupted current flowing through the circuit line 127*a* constant.

It is advisable that the circuit line 127*a* be arranged along at least a portion of the first electrical path Lp1 in order to produce the field which is exactly identical and 180° out of phase with the field arising from the interrupted current i1 flowing through the first electrical path Lp1.

The discharge lamp driver circuit 100 may be, as shown in FIG. 2, disposed in a metal casing 170. In the illustrated case, the control circuit 150, the MOS transistor 122, etc. are fabricated in a hybrid IC. The circuit line 127*a* is connected in series with the first electrical path Lp1 through a terminal 171*a* installed in a resinous inner casing 171.

Figure 3:
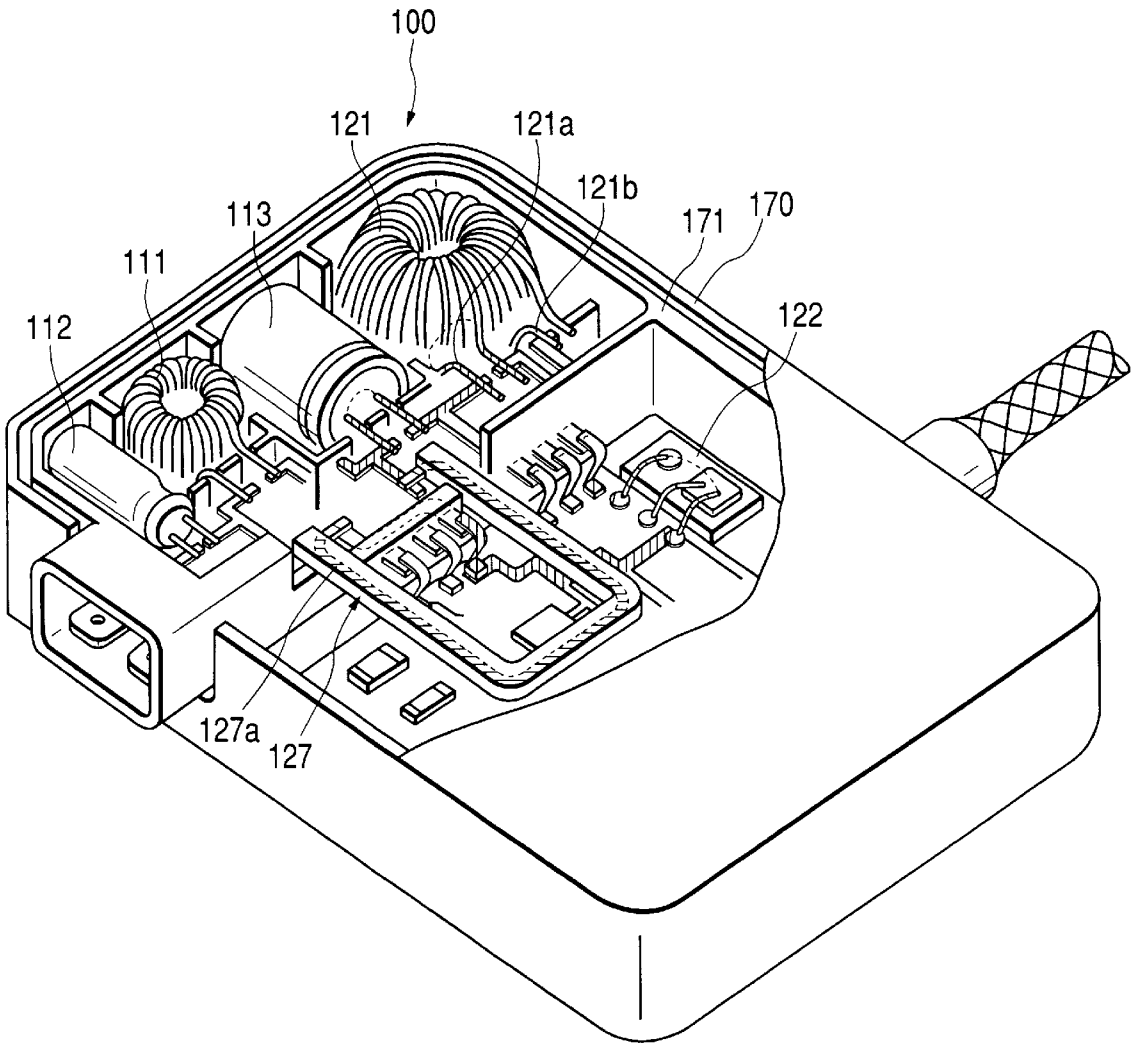
FIG. 3 is a partially cutaway view which shows a discharge lamp driver circuit according to the second embodiment of the invention is installed in a casing.

FIG. 3 shows a discharge lamp driver circuit 100 according to the second embodiment of the invention.

Figure 4:
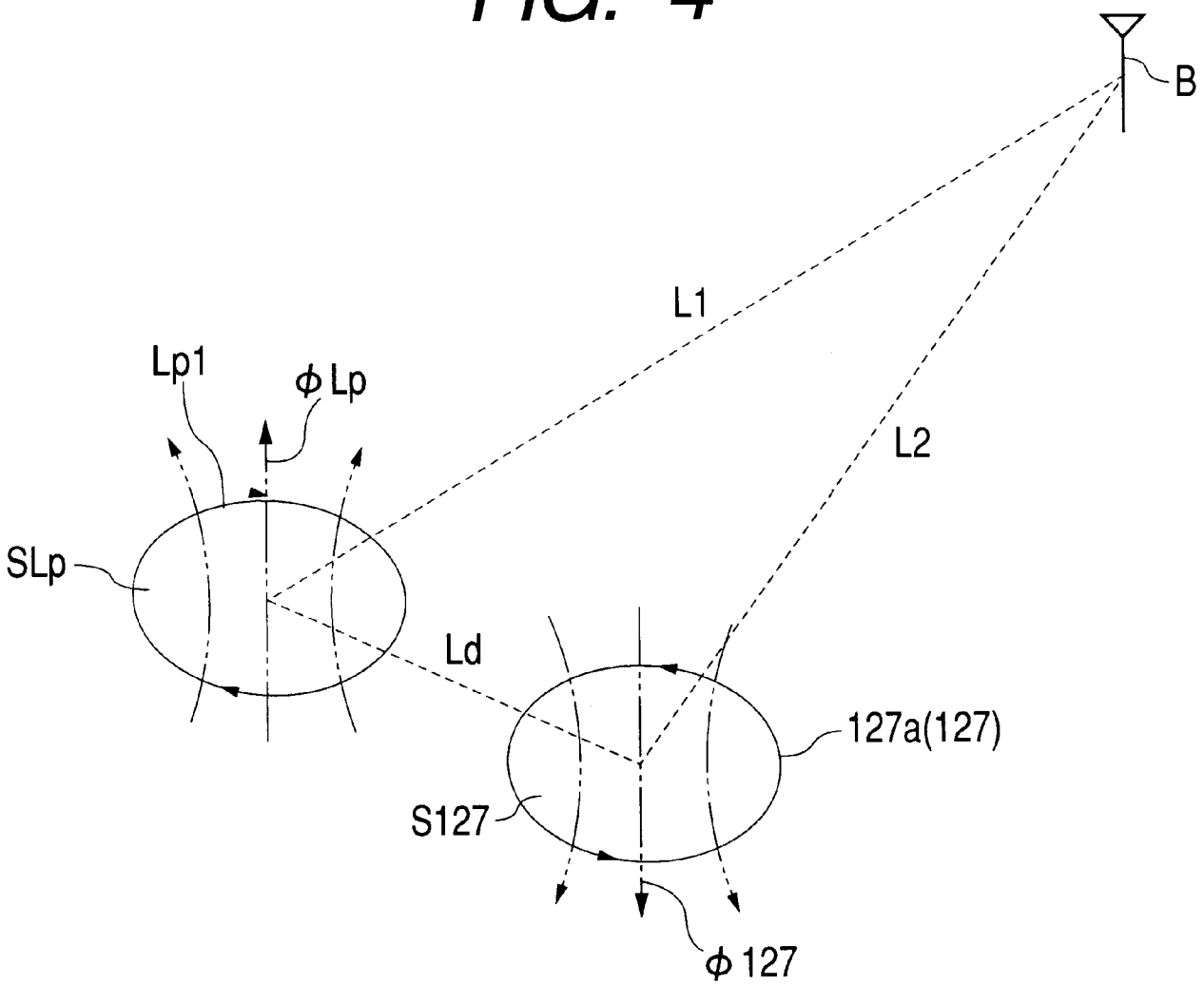
FIG. 4 is an illustration which shows a positional relation between a magnetic flux arising from an on-off operation of a switching element and a magnetic flux working to cancel the former.

The circuit line 127*a* of the field canceller 127 of this embodiment is, unlike the first embodiment, shifted horizontally from the first electrical path Lp1. An area S127, as shown in FIG. 4, surrounded by the circuit line 127*a* is set substantially equal to an area SLp surrounded by the first electrical path Lp1 so that the field ϕ127 produced from the circuit line 127*a* may be identical in strength with the field ϕLp produced from the first electrical path Lp1. Therefore, to the extent that the interval Ld between the circuit line 127*a* and the first electrical path Lp1 is much smaller than both distance L1 between the first electrical path Lp1 and a field-applied point B (e.g., an antennal installed on the rear of a vehicle traveling ahead of a vehicle equipped with the discharge lamp driver circuit 100) and distance L2 between the circuit line 127*a* and the field-applied point B, the field ϕ127 cancels the field ϕLp sufficiently at the field-applied point B, thus eliminating an electric disturbance arising from the field ϕLp.

The circuit line 127*a* of the field canceller 127 may be made of a flexible substrate, thereby facilitating setting of the area S127 surrounded by the circuit line 127*a*. The use of such a flexible substrate also allows the discharge lamp driver circuit 100, especially circuit elements around the DC/DC converter 120 to be reduced in size.

Figure 5:
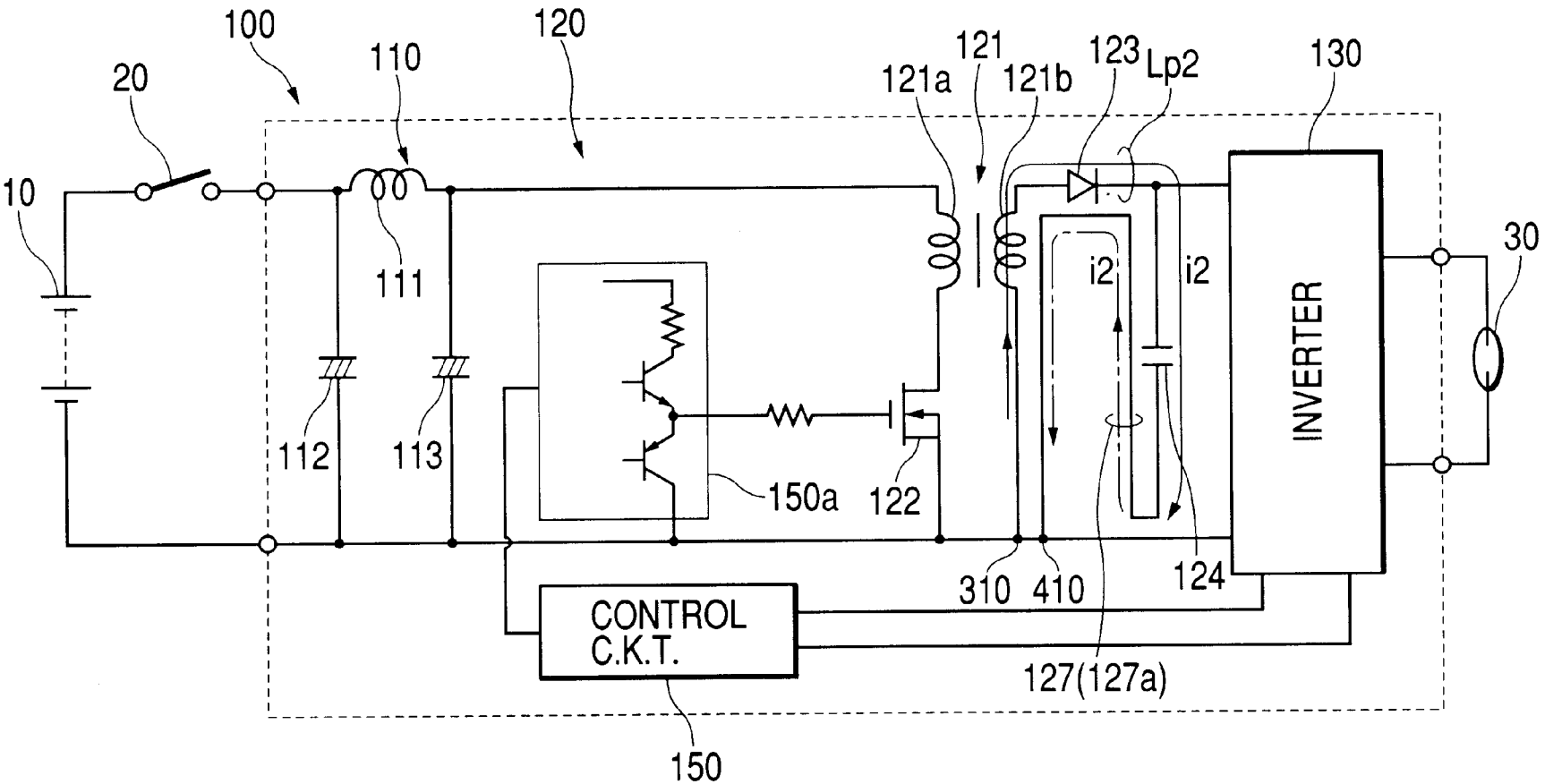
FIG. 5 is a circuit diagram which shows a discharge lamp driver circuit in a first modification of the invention.

The field canceller 127 may also be installed, as shown in FIG. 5, in the discharge lamp driver circuit 100 in order to cancel the field arising from the interrupted current i2 flowing through the second electrical path Lp2 extending from the junction 310 to the secondary winding 121*b* to the rectifier diode 123 and to the smoothing capacitor 124. The field canceller 127 is implemented by the circuit line 127*a* extending from an end of the second electrical path Lp2 extending downward, as viewed in the drawing, from the smoothing capacitor 124 to the junction 410 along the second electrical path Lp2.

Figure 6:
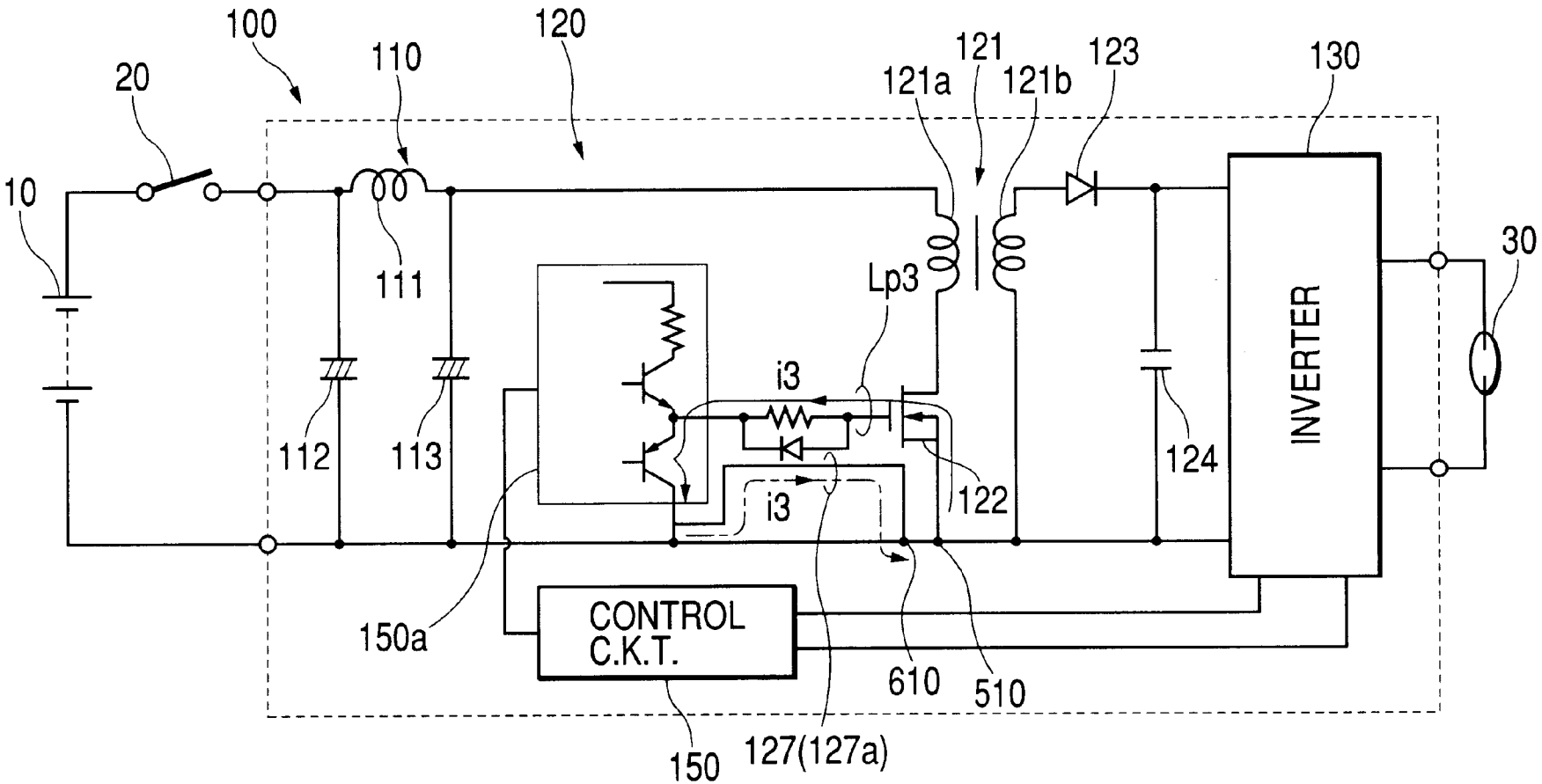
FIG. 6 is a circuit diagram which shows a discharge lamp driver circuit in a second modification of the invention.

Further, the field canceller 127 may be installed, as shown in FIG. 6, in the discharge lamp driver circuit 100 in order to cancel the field arising from the interrupted current i3 flowing through the third electrical path Lp3 extending from the junction 510 to the MOS transistor 122 to the gate control circuit 150*a*. The field canceller 127 is implemented by the circuit line 127*a* extending from an end of the third electrical path Lp3 (i.e., the collector of the transistor of the gate control circuit 150*a*) to the junction 410 along the third electrical path Lp3.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

The invention is not limited to use with the DC/DC converter 122. For instance, the field canceller 127 may be installed in a power supply unit including a semiconductor switching element such as a MOS transistor.

What is claimed is:

1. A discharge lamp driver circuit comprising:

a power supply circuit connected to a dc power supply, including a switching element, said power supply circuit performing an on-off operation on the switching element to step up a dc voltage from the dc power supply and provide the stepped up dc voltage for turning on a discharge lamp, said power supply circuit including an electrical path through which an interrupted current arising from the on-off operation of the switching element flows; and a field canceller including an electrical line through which the same interrupted current as that flowing through the electrical path of said power supply circuit flows to thereby produce a field canceling a field caused by flow of the interrupted current through the electrical path.

2. The discharge lamp driver circuit as set forth in claim 1, wherein said power supply circuit includes a DC/DC converter which has a transformer consisting of a primary winding connected to the dc power supply and a secondary winding connected to the discharge lamp and the switching element and which works to turning on and off the switching element to provide the stepped up dc voltage to the discharge lamp through the transformer.

3. The discharge lamp driver circuit as set forth in claim 1, wherein the electrical line of said field canceller is connected in series with the electrical path of said power supply circuit and extends so as to have the interrupted current bypass the electrical path in an orientation opposite flow of the interrupted current through the electrical path.

4. The discharge lamp driver circuit as set forth in claim 1, wherein the electrical line of said field canceller is so geometrically shaped as to have an area surrounded by the electrical line which is substantially identical with an area surrounded by the electrical path of said power supply circuit.

5. The discharge lamp driver circuit as set forth in claim 1, wherein the electrical line of said field canceller is laid over the electrical path of said power supply circuit so that a magnetic flux produced by the electric line of said field canceller overlaps a magnetic flux produced by the electrical path of said power supply circuit.

6. The discharge lamp driver circuit as set forth in claim 1, wherein said field canceller includes an insert molded body within which the electrical line is disposed.

7. The discharge lamp driver circuit as set forth in claim 1, wherein said field canceller is implemented by a flexible substrate.

* * * * *

UNITED STATES PATENT AND TRADEMARK OFFICE

CERTIFICATE OF CORRECTION

PATENT NO. : 6,700,328 B2
DATED : March 2, 2004
INVENTOR(S) : Toyama, Koichi

It is certified that error appears in the above-identified patent and that said Letters Patent is hereby corrected as shown below:

Title page, Item [54] and Column 1, lines 2-4,
Correct the title "DISCHARGE LAMP DRIVER CIRCUIT DESIGNED TO MINIMIZE RADIATION OR NOISE" to be -- DISCHARGE LAMP DRIVER CIRCUIT DESIGNED TO MINIMIZE RADIATION OF NOISE --

Signed and Sealed this

Fourth Day of May, 2004

JON W. DUDAS
*Acting Director of the United States Patent and Trademark Office*